US006763538B1

(12) United States Patent
Tsai

(10) Patent No.: US 6,763,538 B1
(45) Date of Patent: Jul. 20, 2004

(54) PILLOW

(75) Inventor: Chin Kuo Tsai, Taoyuan County (TW)

(73) Assignee: Peikang Food Co., Ltd, Yuen Lin Hsien (TW)

( * ) Notice: Subject to any disclaimer, the term of this patent is extended or adjusted under 35 U.S.C. 154(b) by 0 days.

(21) Appl. No.: 10/678,452

(22) Filed: Sep. 29, 2003

(30) Foreign Application Priority Data

Jul. 17, 2003 (TW) ..... 92213064 U

(51) Int. Cl.[7] ..... A47G 9/00

(52) U.S. Cl. ..... 5/638; 5/636; 5/640; 5/641; 5/951

(58) Field of Search ..... 5/636, 638, 640, 5/641, 951, 643

(56) References Cited

U.S. PATENT DOCUMENTS 1,274,595 A * 8/1918 Ranz ..... 5/638
3,258,790 A * 7/1966 Marv ..... 5/636
3,403,413 A * 10/1968 Calhoun et al. ..... 5/638

* cited by examiner

*Primary Examiner*—Alexander Grosz

(57) ABSTRACT

A pillow mainly includes two side frames, at least one crosspiece firmly engaged at two outer ends with locating holes provided at two opposite inner sides of the two side frames, and a plurality of round bars extended between the two side frames with respective outer ends rotatably inserted into insertion holes correspondingly spaced along outer edges of the two opposite inner sides of the side frames. With a predetermined clearance existed between any two adjacent insertion holes, the round bars inserted thereinto are adapted to form rotatable and air-pervious supporting surfaces on the pillow.

7 Claims, 3 Drawing Sheets

PILLOW

FIELD OF THE INVENTION

The present invention relates to a pillow, and more particularly to a pillow having supporting surfaces formed from a plurality of round bars that are in rotary contact with a user's head supported thereon.

BACKGROUND OF THE INVENTION

According to our body structure, an angle about 5 degrees is contained between our face and a vertical axis of our body when we stand in an upright position. It would be very comfortable if our neck were in the same 5-degree angular position relative to our body when we are lying on our back. Therefore, there are general three important factors to be considered when designing a pillow: height, hardness, and resilience. The suitable height for pillow varies from user to user. Physiologically speaking, a pillow is preferably 8 to 15 cm in height. The pillow must have a proper hardness. A pillow that is too hard provides only a small contact area with the user's head and has poor supporting effect. On the other hand, a pillow that is too soft tends to sink easily and has adverse influence on the user's blood circulation to result in a paralyzed head. As a matter of fact, a pillow needs only a small extent of resilience to avoid fatigued and impaired neck muscles.

In brief, it is necessary to develop a pillow having material and structure best suitable for a user to rest his head thereon to obtain good sleep quality.

SUMMARY OF THE INVENTION

A primary object of the present invention is to provide a pillow that has air-pervious supporting surfaces formed from rotatable members to interact with a user's head supported thereon.

To achieve the above object, the pillow of the present invention mainly includes two side frames, at least one crosspiece firmly engaged at two outer ends with locating holes provided at two opposite inner sides of the two side frames, and a plurality of round bars extended between the two side frames with respective outer ends rotatably inserted into insertion holes correspondingly spaced along outer edges of the two opposite inner sides of the side frames. With a predetermined clearance existed between any two adjacent insertion holes, the round bars inserted thereinto are adapted to form rotatable and air-pervious supporting surfaces on the pillow.

Another object of the present invention is to provide a pillow that produces suitable resilience to provide proper elastic support to the user's head and has a pharmacological action to help the user to sleep well. To achieve this object, the side frames, the cross pieces, and the round bars of pillow of the present invention all are made of green sandalwood material that has high density and hardness and constantly diffuses a sweet smell beneficial to human health.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
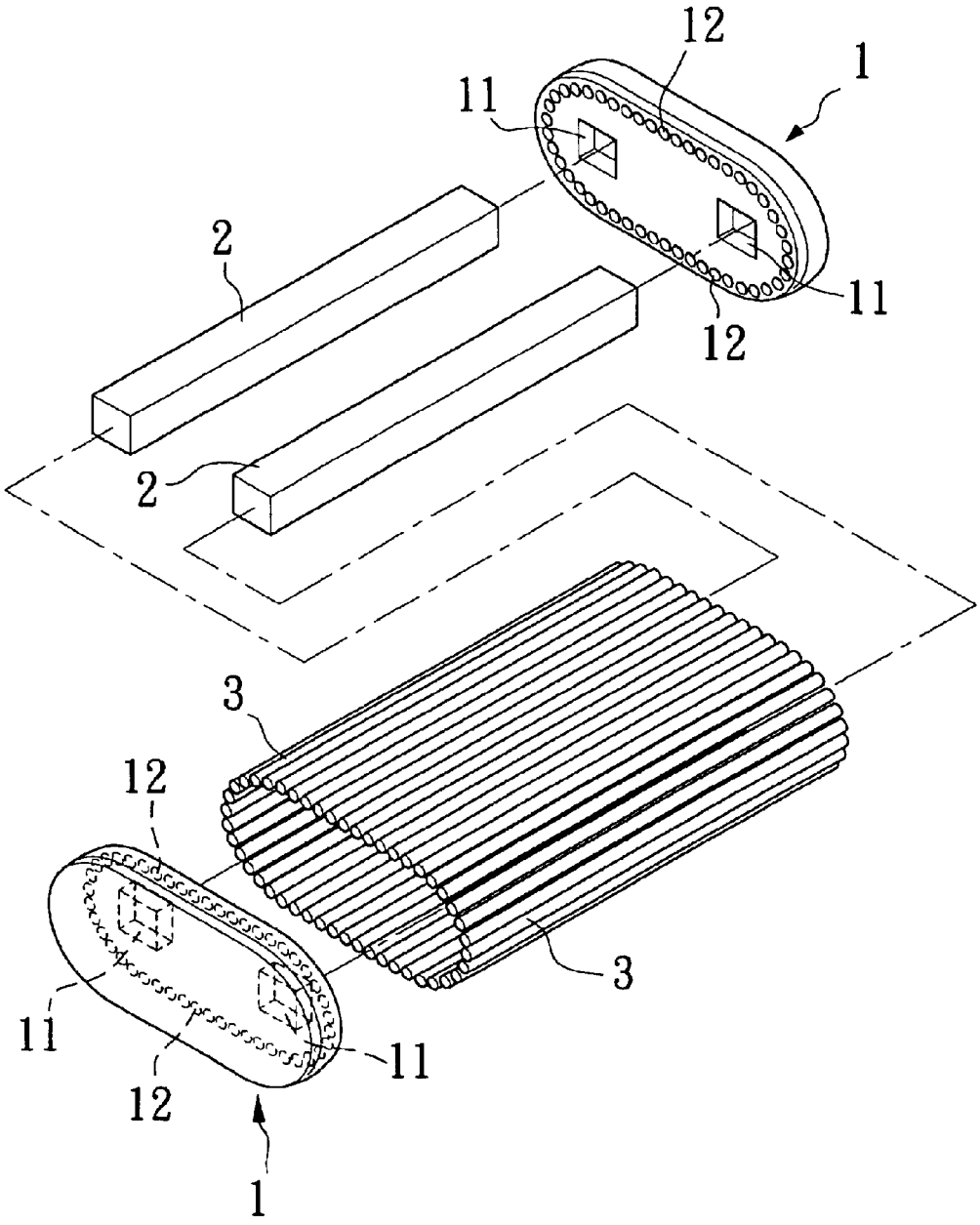
FIG. 1 is an exploded perspective view of a pillow according to the present invention.

Please refer to FIG. 1 that is an exploded perspective view of a pillow according to the present invention. As shown, the pillow mainly includes two side frames 1, at least one crosspiece 2, and a plurality of round bars 3.

Each of the two side frames is a flat board having a predetermined thickness and an oblong shape. The two side frames are provided on two opposite inner surfaces at predetermined positions near a central area thereof with one or more locating holes 11, and along an outer edge thereof with a plurality of equally spaced insertion holes 12.

The crosspiece 2 is provided for connecting to and thereby holding the two side frames 1 in place. The crosspiece 2 may be a thick bar, a thick plate, or other members having different geometrical cross sections. However, the crosspiece 2 should always has two end portions having a cross sectional shape corresponding to that of the locating holes 11 on the two side frames 1.

The round bars 3 are made of a material providing some extent of elastic deformation, and have a diameter slightly smaller than that of the insertion holes 12 on the side frames 1, so that the round bars 3 are freely rotatably mounted at respective outer ends in the insertion holes 12 to rotate relative to the insertion holes 12 under an external rotary force.

Figure 2:
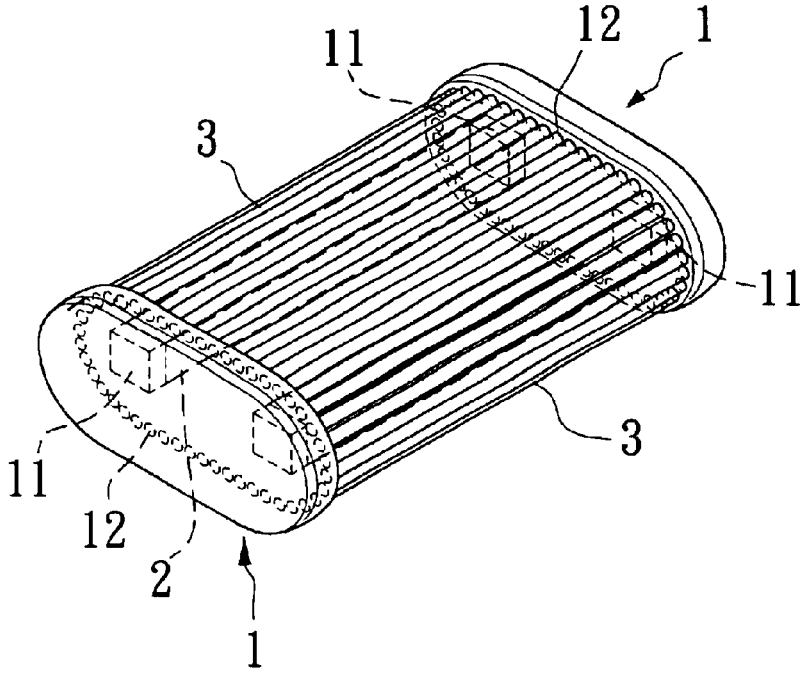
FIG. 2 is an assembled perspective view of the pillow of FIG. 1.

The locating hole 11 and the crosspiece 2 are of the same in number. Two outer ends of each crosspiece 2 are firmly engaged with the locating holes 11 to connect the side frames 1 to the crosspieces 2. The round bars 3 are separately rotatably connected at respective outer ends to the insertion holes 12, so as to extend across a space defined between the two side frames 1. And, a pillow having air-pervious supporting surfaces with rotatable bars is completed, as shown in FIG. 2.

In a preferred embodiment of the present invention, the two side frames, the at least one crosspiece 2, and the round bars 3 all are made of a material obtained from green sandalwood, which has high density and high rigidity, so that the supporting surfaces of the pillow formed from the round bars 3 supports a user's head with a proper resilience. When the user's head supported on the pillow is shifted and causes the round bars 3 to pivotally rotate between the two side frames 1, there is only a very small friction of rolling with the insertion holes 12 to be born by the round bars 3 without the risk of causing serious wearing loss of the round bars 3 or the insertion holes 12. Moreover, the green sandalwood, due to its natural pharmacological action, tends to help the user to sleep well.

Figure 3:
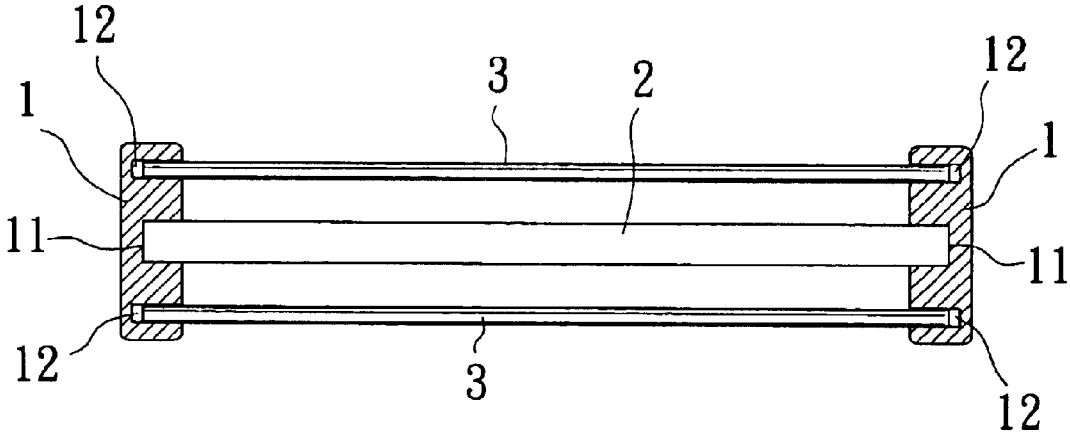
FIG. 3 is a sectioned front view of the pillow of FIG. 2.

FIG. 3 is a sectioned front view of the pillow of the present invention. As can be clearly seen from FIG. 3, when the at least one crosspiece 2 is fully engaged with the two side frames 1 to support and locate the same in place, each of the round bars 3 is extended between two corresponding insertion holes 12 with a small distance left between each outer end of the round bar 3 and an innermost end of the insertion hole 12 receiving the round bar 3. In this manner, the round bars 3 are allowed to freely rotate when a user's head shifts on the supporting surface of the pillow formed from the round bars 3 without the risk of clamping or pinching the user's hairs, as shown in FIG. 4.

Figure 4:
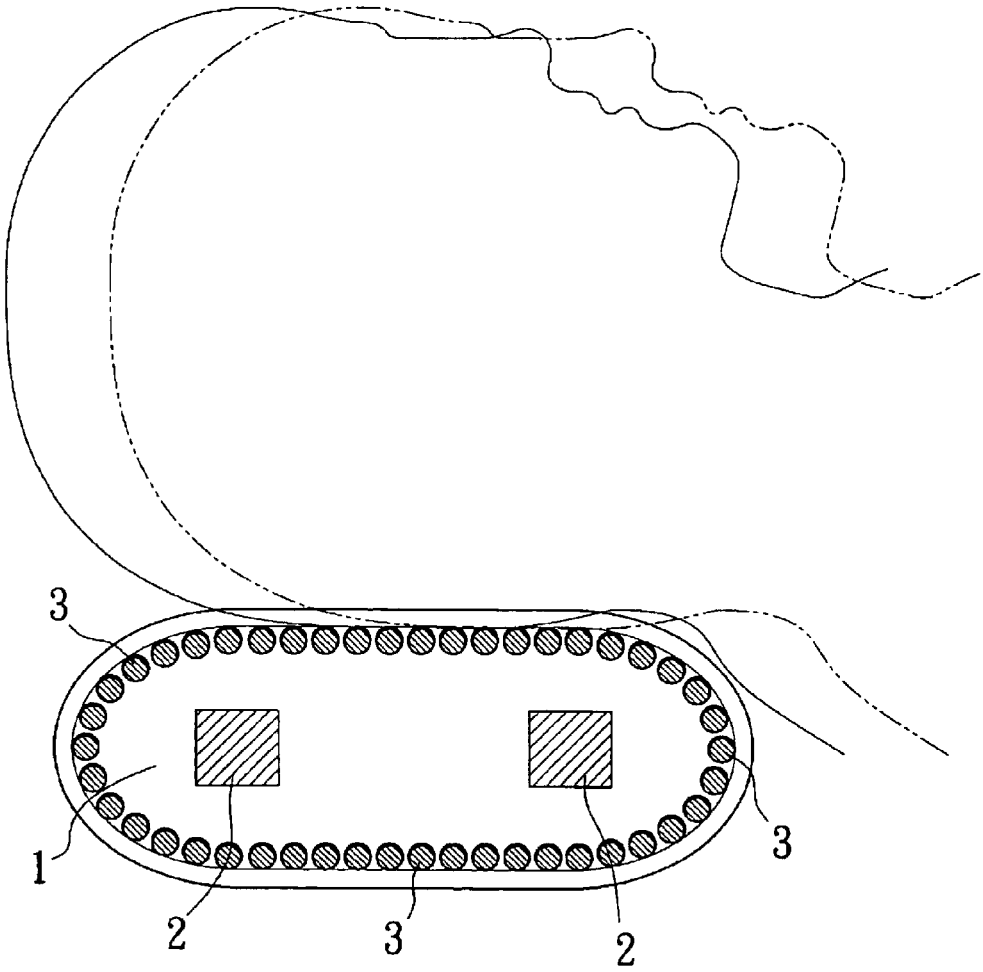
FIG. 4 shows the use of the pillow of the present invention.

FIG. 4 also clearly shows the insertion holes 12 provided along the outer edge of each side frame 1 of the pillow are spaced from each other by a predetermined clearance. These clearances between the insertion holes 12 allows formation of air passages on the supporting surfaces of the pillow formed from the round bars 3 inserted into the spaced insertion holes 12. The air passages and a hollow space defined in the pillow together provide the pillow good air permeability for the user's head to comfortably support thereon. A natural sweet smell of the green sandalwood constantly diffuses through the user's hairs, and freshens and aromatizes the space in which the user sleeps.

What is claimed is:

1. A pillow, comprising two side frames, at least one crosspiece, and a plurality of round bars;

each of said side frames being a flat board having a predetermined thickness, and provided on an inner side at a predetermined position in a central area thereof with a predetermined number of locating holes and along an outer edge of said inner side with a plurality of spaced insertion holes;

said at least one crosspiece having two outer ends having a cross sectional shape corresponding to that of said locating holes separately provided on said inner side of said side frames, so as to engage at said two outer ends with said locating holes to connect to and locate said side frames in place; and said round bars being made of a material allowing some extent of elastic deformation, and having a diameter slightly smaller than that of said insertion holes; said round bars being rotatably connected at respective outer ends to said two side frames by inserting said outer ends into said spaced insertion holes on said inner sides of said side frames, such that supporting surfaces pervious to air are formed from said round bard between said two side frames.

2. The pillow as claimed in claim 1, wherein each of said round bars is extended between two corresponding insertion holes with a small distance left between each outer end of said round bar and an innermost end of said insertion hole receiving said round bar when said at least one crosspiece has been fully engaged with said two side frames at said locating holes.

3. The pillow as claimed in claim 1, wherein said locating holes provided on said inner side of each said side frame may be one or more in number.

4. The pillow as claimed in claim 1, wherein said crosspiece is selected from a group consisting of a thick bar, a thick plate, and other members having different geometrical cross sectional shapes.

5. The pillow as claimed in claim 1, wherein said side frames are made of green sandalwood material.

6. The pillow as claimed in claim 1, wherein said at least one crosspiece is made of green sandalwood material.

7. The pillow as claimed in claim 1, wherein said round bars are made of green sandalwood material.

* * * * *